US011258171B2

(12) United States Patent
Izawa et al.

(10) Patent No.: US 11,258,171 B2
(45) Date of Patent: Feb. 22, 2022

(54) ANTENNA

(71) Applicant: Murata Manufacturing Co., Ltd., Kyoto (JP)

(72) Inventors: Masahiro Izawa, Kyoto (JP); Yoshiki Yamada, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 139 days.

(21) Appl. No.: 16/704,191

(22) Filed: Dec. 5, 2019

(65) Prior Publication Data

US 2020/0106179 A1 Apr. 2, 2020

Related U.S. Application Data

(63) Continuation of application No. PCT/JP2018/020132, filed on May 25, 2018.

(30) Foreign Application Priority Data

Jun. 6, 2017 (JP) ..... JP2017-111465

(51) Int. Cl.
*H01Q 5/378* (2015.01)
*H01Q 1/38* (2006.01)
(Continued)

(52) U.S. Cl.
CPC ..... *H01Q 5/378* (2015.01); *H01Q 1/243* (2013.01); *H01Q 1/38* (2013.01); *H01Q 1/48* (2013.01)

(58) Field of Classification Search
CPC ..... H01Q 21/065; H01Q 1/243; H01Q 5/378; H01Q 1/38; H01Q 1/48; H01Q 9/0414
See application file for complete search history.

(56) References Cited

U.S. PATENT DOCUMENTS 5,382,959 A * 1/1995 Pett ..... H01Q 21/065 343/700 MS
5,760,744 A * 6/1998 Sauer ..... B32B 17/10036 29/600
(Continued)

FOREIGN PATENT DOCUMENTS

CN 101847768 A 9/2010
JP S60-48294 U 4/1985
(Continued)

OTHER PUBLICATIONS

Rajesh Kumar Vishwakarma, Design of Rectangular Stacked Microstrip Antenna For Dual-Band, 2009 International Conference on Emerging Trends in Electronic and Photonic Devices & Systems (ELECTRO-2009), Department of Electronics and Communication Engineering, Jaypee Institute of Engineering and Technology, Downloaded May 13, 2020, pp. 328-331, IEEE, State Intellectual Property Office of China.
(Continued)

*Primary Examiner* — Graham P Smith
*Assistant Examiner* — Jae K Kim
(74) *Attorney, Agent, or Firm* — Pearne & Gordon LLP

(57) ABSTRACT

An antenna includes a dielectric substrate, a radiating element, a parasitic element, and a ground conductor. The dielectric substrate has a plate-like shape having a top face and a back face opposite to each other. The radiating element is placed between the top face and the back face of the dielectric substrate and transmits and receives a radio frequency signal of a first frequency. The parasitic element is placed on the top face of the dielectric substrate and transmits and receives a radio frequency signal of a second frequency. The ground conductor is placed on the back face of the dielectric substrate. The second frequency is a lower frequency than the first frequency. The dielectric substrate has an electric field boundary plane that reflects a radio
(Continued)

frequency signal of the second frequency at an intermediate position in a thickness direction orthogonal to the top face and the back face.

12 Claims, 3 Drawing Sheets

(51) Int. Cl.
*H01Q 1/48* (2006.01)
*H01Q 1/24* (2006.01)

(56) References Cited

U.S. PATENT DOCUMENTS 6,476,771 B1* 11/2002 McKinzie, III ..... H01Q 1/425 333/134
6,903,687 B1* 6/2005 Fink ..... H01Q 9/0407 333/126
2007/0085626 A1* 4/2007 Lee ..... H01P 5/107 333/26
2007/0126638 A1* 6/2007 Channabasappa ... H01Q 9/0442 343/700 MS
2008/0048917 A1* 2/2008 Achour ..... H01Q 9/0407 343/700 MS
2013/0017348 A1 1/2013 Sanada
2015/0303576 A1* 10/2015 Latrach ..... H01Q 9/0407 343/700 MS
2018/0123236 A1* 5/2018 Van Gils ..... H01Q 9/0414
2018/0294567 A1* 10/2018 O'Brien ..... H01Q 9/0414
2019/0103682 A1* 4/2019 Thai ..... H01Q 13/16
2019/0207314 A1* 7/2019 Oladeinde ..... H01Q 21/24
2020/0035560 A1* 1/2020 Block ..... H01L 27/1203

FOREIGN PATENT DOCUMENTS

JP 2001-326528 A 11/2001
JP 2003-298339 A 10/2003
JP 2017-092588 A 5/2017
WO 2011/118710 A1 9/2011

OTHER PUBLICATIONS

D. Mirshekar-Syahkal and H.R. Hassani, Characteristics of Stacked Rectangular and Triangular Patch Antennas For Dual Band Applications, University of Essex, UK, 1993 Eighth International Conference on Antennas and Propagation, Downloaded May 13, 2020, pp. 728-731, IEEE, State Intellectual Property Office of China.
Notification of the First Office Action for Chinese Patent Application No. 201880037240.5, dated Jun. 15, 2020.
International Search Report for International Application No. PCT/JP2018/020132 dated Aug. 7, 2018.
Written Opinion for International Application No. PCT/JP2018/020132 dated Aug. 7, 2018.

* cited by examiner (PRESENT APPLICATION CONFIGURATION)

(COMPARISON CONFIGURATION)

ANTENNA

This is a continuation of International Application No. PCT/JP2018/020132 filed on May 25, 2018 which claims priority from Japanese Patent Application No. 2017-111465 filed on Jun. 6, 2017. The contents of these applications are incorporated herein by reference in their entireties.

BACKGROUND OF THE DISCLOSURE

Field of the Disclosure

The present disclosure relates to an antenna that transmits and receives a plurality of radio frequency signals of different frequencies.

Description of the Related Art

In general, as antennas for mobile communication terminals and the like, various kinds of small-size antenna devices are put to practical use. For example, patent document 1 and patent document 2 each describe a patch antenna including a radiating element being fed with a radio frequency signal by a conductor and a parasitic element that uses electromagnetic coupling.

In an antenna described in the patent document 1, the parasitic element forms a loop-like slot antenna. The antenna described in the patent document 1 makes the frequency of a first radio frequency signal being transmitted and received at the radiating element different from the frequency of a second radio frequency signal being transmitted and received at the parasitic element by appropriately setting shapes of the radiating element and the parasitic element. Because of this, the antenna described in the patent document 1 is a dual frequency shared antenna.

An antenna described in the patent document 2 uses the parasitic element as a booster antenna and is a single frequency antenna. Further, the antenna described in the patent document 2 includes a bent-shaped reflector conductor bending toward the side opposite to a radiation plane side of the radiating element, and radiation characteristics thereof are adjusted by varying the shape of the reflector conductor.

Patent Document 1: Japanese Unexamined Patent Application Publication No. 2003-298339

Patent Document 2: Japanese Unexamined Patent Application Publication No. 2001-326528

BRIEF SUMMARY OF THE DISCLOSURE

However, the antenna described in the patent document 1 is a combination of the patch antenna and the loop-like slot antenna, and the loop-like slot antenna is placed between the radiating element and a ground conductor. Because of this, the overall shape of the antenna becomes complex, and it is not easy to achieve the desired characteristics.

The antenna described in the patent document 2 uses the reflector conductor to adjust the characteristics of the antenna and requires elements other than a radiating element and a parasitic element that transmit and receive radio frequency signals. Further, in a case where the antenna described in the patent document 2 is applied to a dual frequency shared antenna, it is not easy to realize the reflector conductor having the shape suitable for two frequencies.

Accordingly, an object of the present disclosure is to realize a simple and small antenna capable of achieving the desired characteristics for a dual frequency.

An antenna of this disclosure includes a dielectric substrate, a radiating element, a parasitic element, and a ground conductor. The dielectric substrate has a plate-like shape having a top face and a back face that are opposite to one another. The radiating element is placed between the top face and the back face of the dielectric substrate and transmits and receives a radio frequency signal of a first frequency. The parasitic element is placed on the top face of the dielectric substrate and transmits and receives a radio frequency signal of a second frequency. The ground conductor is placed on the back face of the dielectric substrate. The second frequency is a lower frequency than the first frequency. The dielectric substrate has an electric field boundary plane that reflects a radio frequency signal of the second frequency at an intermediate position in a thickness direction orthogonal to the top face and the back face.

In this configuration, for a radio frequency signal of the second frequency, the distance from the parasitic element to the ground conductor becomes longer.

Further, the antenna of this disclosure preferably has the following configuration. The dielectric substrate includes a first dielectric layer having a first relative permittivity and a second dielectric layer having a second relative permittivity, the second relative permittivity being a lower permittivity than the first relative permittivity. The first dielectric layer and the second dielectric layer are stacked on top of one another, and a face of the second dielectric layer on the side opposite to a first dielectric layer side of the second dielectric layer is the top face of the dielectric substrate.

In this configuration, a boundary plane between two layers of the dielectric layers having different relative permittivities serves as the electric field boundary plane that causes reflection.

Further, in the antenna of this disclosure, a difference in relative permittivity between the first relative permittivity and the second relative permittivity is preferably 3 or greater.

In this configuration, the extent of a band for a radio frequency signal of the second frequency is more secured.

Further, in the antenna of this disclosure, the first dielectric layer and the second dielectric layer may be different in material.

In this configuration, the electric field boundary plane that causes reflection is formed by stacking the dielectric layers of different materials on top of one another.

Further, in the antenna of this disclosure, the first dielectric layer and the second dielectric layer may comprise the same material, and the first dielectric layer or the second dielectric layer may include an adjustment member that changes an effective relative permittivity.

In these configurations, for the dielectric substrates of one kind of material, the electric field boundary plane that causes reflection is formed.

Further, in the antenna of this disclosure, the second dielectric layer may include the adjustment member that lowers an effective relative permittivity of the second dielectric layer.

In this configuration, the electric field boundary plane that causes reflection is formed by adjusting the relative permittivity of the second dielectric layer.

Further, in the antenna of this disclosure, the first dielectric layer may include the adjustment member that increases an effective relative permittivity of the first dielectric layer.

In this configuration, the electric field boundary plane that causes reflection is formed by adjusting the relative permittivity of the first dielectric layer.

Further, the antenna of this disclosure may have the following configuration. The antenna includes a plurality of parasitic elements each having a shape similar to that of the foregoing parasitic element and a plurality of radiating elements each having a shape similar to that of the foregoing radiating element. The plurality of parasitic elements and the plurality of radiating elements are arrayed.

In this configuration, an array antenna is formed, and the distances from the plurality of parasitic elements to the ground conductor for a radio frequency signal of the second frequency becomes longer.

This disclosure enables to realize an antenna capable of achieving the desired characteristics for a dual frequency simply with a smaller size.

DETAILED DESCRIPTION OF THE DISCLOSURE

Figure 1A:
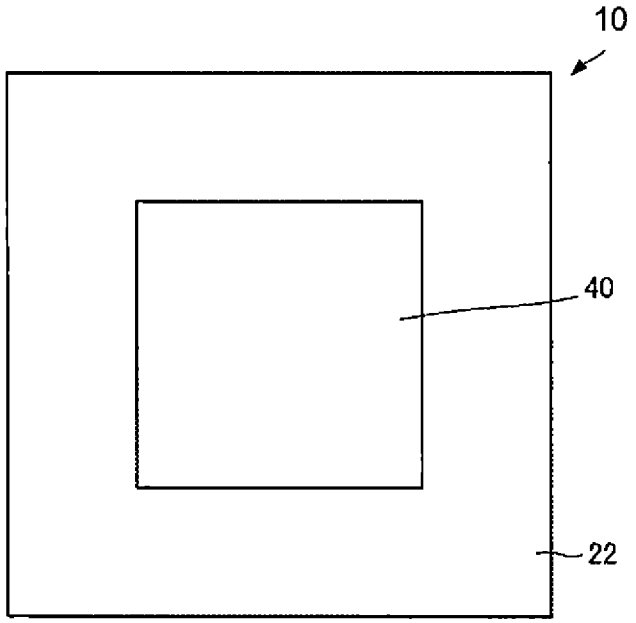
FIG. 1A is a plan view of an antenna 10 according to a first embodiment of the present disclosure.
Figure 1B:
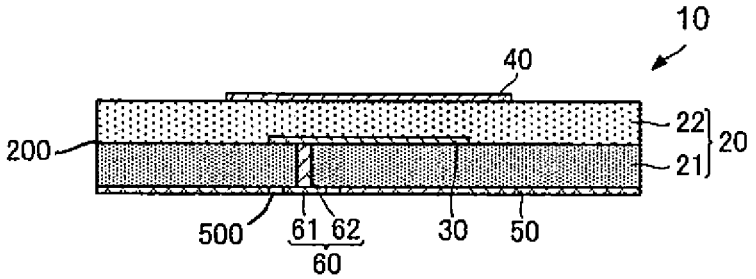
FIG. 1B is a side cross-sectional view of the antenna 10.
Figure 2:
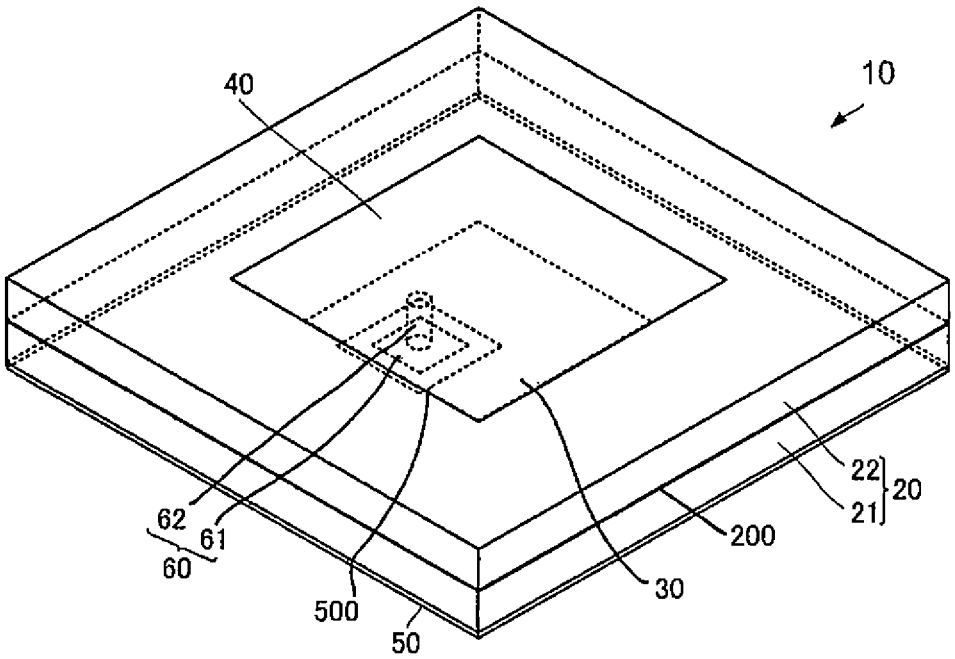
FIG. 2 is an external perspective view of the antenna 10 according to the first embodiment of the present disclosure.

An antenna according to a first embodiment of the present disclosure is described with reference to the drawings. FIG. 1A is a plan view of an antenna 10 according to the first embodiment of the present disclosure, and FIG. 1B is a side cross-sectional view of the antenna 10. FIG. 2 is an external perspective view of the antenna 10 according to the first embodiment of the present disclosure.

As illustrated in FIG. 1A, FIG. 1B, and FIG. 2, the antenna 10 includes a dielectric substrate 20, a radiating element 30, a parasitic element 40, a ground conductor 50, and a feed conductor 60.

The dielectric substrate 20 is rectangular in the plan view. The dielectric substrate 20 includes a first dielectric layer 21 and a second dielectric layer 22. The first dielectric layer 21 and the second dielectric layer 22 are both a rectangular flat film in the plan view. The first dielectric layer 21 and the second dielectric layer 22 are stacked on top of each other in such a way that their flat film faces are opposite to each other. In the first dielectric layer 21, a face on the side opposite to the face on a second dielectric layer 22 side is the back face of the dielectric substrate 20, and in the second dielectric layer 22, a face on the side opposite to the face on a first dielectric layer 21 side is the top face of the dielectric substrate 20. In other words, the dielectric substrate 20 has the top face and the back face that are opposite to each other and has a structure in which the first dielectric layer 21 and the second dielectric layer 22 are stacked on top of each other in a thickness direction orthogonal to the top face and the back face.

The first dielectric layer 21 is composed of a material having relative permittivity εr1. The relative permittivity εr1 corresponds to the "first relative permittivity" of the present disclosure. The first dielectric layer 21 is composed of, for example, LTCC (low temperature co-fired ceramics) or the like. Preferably, the relative permittivity εr1 is 10 or less.

The second dielectric layer 22 is composed of a material having relative permittivity εr2. The relative permittivity εr2 corresponds to the "second relative permittivity" of the present disclosure. The second dielectric layer 22 is composed of, for example, polyimide or the like. The relative permittivity εr2 is lower than the relative permittivity εr1. More specifically, the relative permittivity εr2 is preferably less than the relative permittivity εr1 by three or more.

Having such a relative permittivity relationship between the first dielectric layer 21 and the second dielectric layer 22 enables to form an electric field boundary plane 200 between the first dielectric layer 21 and the second dielectric layer 22. The electric field boundary plane 200 acts in such a manner as to reflect a part of an electric field moving from the second dielectric layer 22 to the first dielectric layer 21.

The radiating element 30 is rectangular in the plan view and is composed of a metal such as copper (Cu) or the like. The radiating element 30 is formed with such dimensions that enable the transmission and reception of a radio frequency signal of a first frequency (first radio frequency signal). Note that the first frequency here is not limited to a frequency at a point on the frequency axis, but is a "frequency" that has a predetermined frequency width (frequency band).

The radiating element 30 is placed at an intermediate position in the thickness direction of the dielectric substrate 20. More specifically, the radiating element 30 is placed at a contact plane between the first dielectric layer 21 and the second dielectric layer 22.

The parasitic element 40 has a rectangular shape with an opening at a center in the plan view and is composed of a metal such as copper (Cu) or the like. The planar area of the parasitic element 40 is larger than the planar area of the radiating element 30, and the parasitic element 40 is formed with such dimensions that enable the transmission and reception of a radio frequency signal of a second frequency (second radio frequency signal). Note that the second frequency here is not limited to a frequency at a point on the frequency axis, but is a "frequency" that has a predetermined frequency width (frequency band).

The first frequency is a higher frequency than the second frequency. In other words, the second frequency is a lower frequency than the first frequency. For example, the first frequency is a 39 GHz band, and the second frequency is a 26 GHz band.

The parasitic element 40 is placed on the top face of the dielectric substrate 20, namely on the face of the second dielectric layer 22 opposite to the contact plane with the first dielectric layer 21. In the plan view, the parasitic element 40 overlaps the radiating element 30.

The ground conductor 50 is composed of a metal such as copper (Cu) or the like. The ground conductor 50 is placed across substantially the whole area of the back face of the dielectric substrate 20, namely across substantially the whole area of the face of the first dielectric layer 21 opposite to the contact plane with the second dielectric layer 22.

The feed conductor 60 includes a feed terminal conductor 61 and a connection conductor 62. The feed terminal conductor 61 is rectangular and composed of a metal such as copper (Cu) or the like. The feed terminal conductor 61 is placed on the back face of the dielectric substrate 20. The feed terminal conductor 61 is isolated from the ground conductor 50 with a no-conductor-formation part 500 interposed therebetween. The connection conductor 62 is a so-called via conductor that uses silver (Ag) paste or the like and is a conductor penetrating the first dielectric layer 21 in the thickness direction. The connection conductor 62 connects the feed terminal conductor 61 and the radiating element 30.

With such configuration, upon receiving power for the first radio frequency signal from the feed conductor 60, the antenna 10 radiates the first radio frequency signal from the radiating element 30. Further, upon receiving power for a second radio frequency signal from the feed conductor 60, the antenna 10 radiates the second radio frequency signal from the parasitic element 40.

Figure 3A:
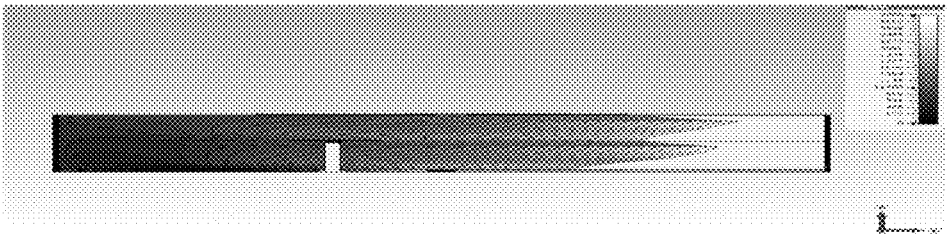
FIG. 3A is a simulation result illustrating an electric field distribution of the antenna 10 according to the first embodiment of the present disclosure.

Here, as described above, in the dielectric substrate 20, the electric field boundary plane 200 is formed at the intermediate position in the thickness direction. As illustrated in FIG. 3A, from the radiation plane of the second radio frequency signal toward the ground conductor 50, an electric field discontinuity plane is formed.

Figure 3B:
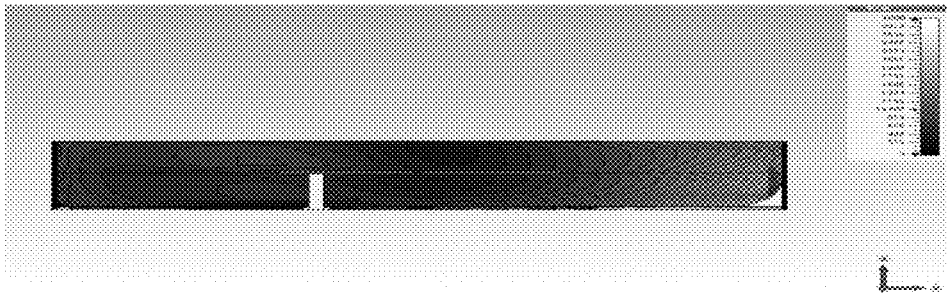
FIG. 3B is a simulation result illustrating an electric field distribution of an antenna of a comparison configuration.

FIG. 3A is a simulation result illustrating an electric field distribution of the antenna 10 according to the first embodiment of the present disclosure, and FIG. 3B is a simulation result illustrating an electric field distribution of an antenna of a comparison configuration. FIG. 3A illustrates a case where the relative permittivity εr1 is 6.3 and the relative permittivity εr2 is 2.3. The comparison configuration illustrated in FIG. 3B has, structure-wise, a configuration similar to the configuration according to the first embodiment of the present disclosure, and in this configuration, the difference between the relative permittivity εr1 and the relative permittivity εr2 is small. In FIG. 3A and FIG. 3B, lighter color indicates stronger electric field intensity, and darker color indicates weaker electric field intensity.

As illustrated in FIG. 3A and FIG. 3B, compared with the comparison configuration, the discontinuity of electric field at the electric field boundary plane 200 improves by using the configuration of the first embodiment of the present disclosure.

In particular, in a case where the difference between the relative permittivity εr1 and the relative permittivity εr2 is 3 or greater, the discontinuity of electric field at the electric field boundary plane 200 such as illustrated in FIG. 3A improves further.

Further, because the relative permittivity εr1 is higher than the relative permittivity εr2, the electric field boundary plane 200 functions as a reflection plane that reflects a second radio frequency signal from the parasitic element 40 toward the ground conductor 50. This enables to make the distance from the parasitic element 40 to the ground conductor 50 for the second radio frequency signal longer than its physical distance. Accordingly, the frequency band of the second radio frequency signal radiated from the parasitic element 40 becomes wider. In other words, the band characteristics for the second radio frequency signal are improved, and thereby enabling to realize the desired radiation characteristics for the second radio frequency signal.

On the other hand, the first radio frequency signal has a higher frequency compared with the second radio frequency signal, and the radiating element 30 is placed at the boundary plane between the first dielectric layer 21 and the second dielectric layer 22. Accordingly, the first radio frequency signal hardly receives any influence of the electric field boundary plane 200, thereby enabling to realize the desired radiation characteristics for the first radio frequency signal.

Figure 4:
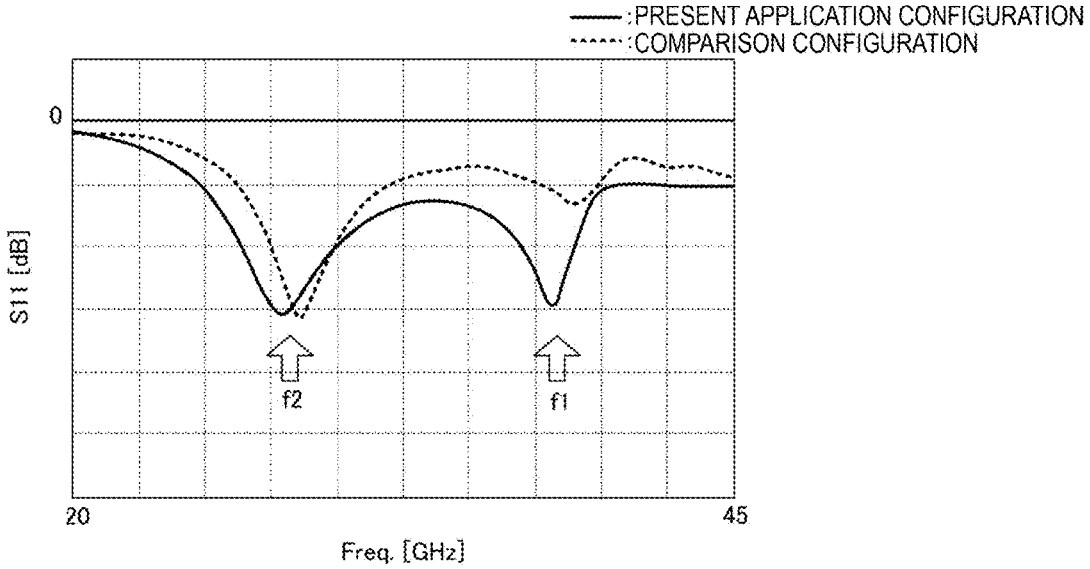
FIG. 4 is a graph illustrating a frequency characteristic of R.L. (return loss) of the antenna 10 according to the first embodiment of the present disclosure and a frequency characteristic of R.L. (return loss) of the antenna of the comparison configuration.

FIG. 4 is a graph illustrating a frequency characteristic of R.L. (return loss) of the antenna 10 according to the first embodiment of the present disclosure and a frequency characteristic of R.L. (return loss) of the antenna of the comparison configuration.

In FIG. 4, f1 denotes a frequency band of the first frequency, and f2 denotes a frequency band of the second frequency. As illustrated in FIG. 4, whereas the reflection at the first frequency f1 is larger in the antenna of the comparison configuration, in the antenna 10 of the present embodiment, the reflection at the first frequency f1 is smaller, and a wider width of a predetermined frequency band where return loss is suppressed can be secured. On the other hand, similarly, for the second frequency f2, the reflection is also smaller, and a wider width of a frequency band where return loss is suppressed can be secured.

In this way, the antenna 10 of the present embodiment enables to realize a wide frequency band for a dual frequency and realize the desired radiation characteristics. Further, in the antenna 10 of the present embodiment, there is no need to use a reflector conductor or the like, and a wide frequency band for a dual frequency can be realized with minimum constituting elements for transmitting and receiving the first radio frequency signal and the second radio frequency signal. In other words, a simple and small antenna capable of achieving the desired characteristics for a dual frequency can be realized.

Note that in the foregoing description, the simulation result of the case where the difference between the relative permittivity εr1 and the relative permittivity εr2 is 3 or greater is described, but this difference can be appropriately adjusted according to the desired radiation characteristics of the antenna 10. However, setting this difference to be 3 or greater increases the foregoing extending effect of the effective distance due to the reflection of the second radio frequency signal. Accordingly, this difference is preferably 3 or greater. Further, in the foregoing description, it is assumed that the relative permittivity εr1 is 10 or less. Alternatively, the relative permittivity εr1 may be greater than 10 depending on the specification of the antenna 10. However, setting the relative permittivity εr1 to be 10 or less enables to suppress the degradation of the radiation characteristics of the first radio frequency signal. Accordingly, the relative permittivity εr1 is preferably 10 or less.

Figure 5:
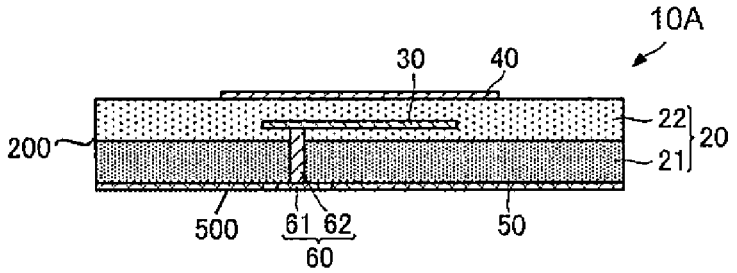
FIG. 5 is a side cross-sectional view of an antenna 10A according to a second embodiment of the present disclosure.

Next, an antenna according to a second embodiment of the present disclosure is described with reference to the drawings. FIG. 5 is a side cross-sectional view of an antenna 10A according to the second embodiment of the present disclosure.

As illustrated in FIG. 5, the antenna 10A according to the second embodiment is different from the antenna 10 according to the first embodiment in the position of the radiating element 30. The remaining configuration of the antenna 10A is similar to the configuration of the antenna 10, and the description regarding similar parts is omitted.

The radiating element 30 is placed inside the second dielectric layer 22 in the dielectric substrate 20. Even with such configuration, as is the case with the first embodiment, the extending effect of the distance from the parasitic element 40 to the ground conductor 50 for the second radio frequency signal is achieved. Accordingly, the antenna 10A achieves functions and effects similar to those of the antenna 10. Further, this configuration enables to strengthen the coupling between the radiating element 30 and the parasitic element 40. Further, the distance between the radiating element 30 and the ground conductor 50 becomes longer, and the band of the first radio frequency signal can be made wider.

Figure 6:
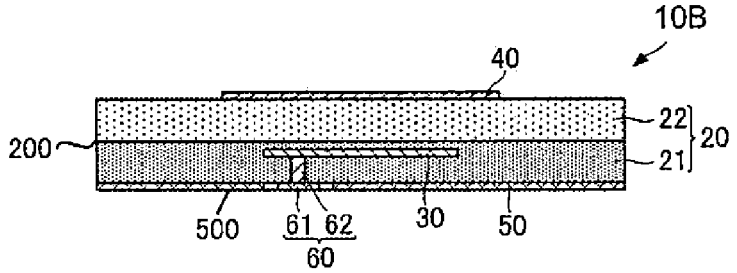
FIG. 6 is a side cross-sectional view of an antenna 10B according to a third embodiment of the present disclosure.

Next, an antenna according to a third embodiment of the present disclosure is described with reference to the drawings. FIG. 6 is a side cross-sectional view of an antenna 10B according to the third embodiment of the present disclosure.

As illustrated in FIG. 6, the antenna 10B according to the third embodiment is different from the antenna 10 according to the first embodiment in the position of the radiating element 30. The remaining configuration of the antenna 10B is similar to the configuration of the antenna 10, and the description regarding similar parts is omitted.

The radiating element 30 is placed inside the first dielectric layer 21 in the dielectric substrate 20. Even with such configuration, as is the case with the first embodiment, the extending effect of the distance from the parasitic element 40 to the ground conductor 50 for the second radio frequency signal is achieved. Accordingly, the antenna 10B achieves functions and effects similar to those of the antenna 10. Further, this configuration enables to suppress unwanted coupling between the radiating element 30 and the parasitic element 40.

Figure 7:
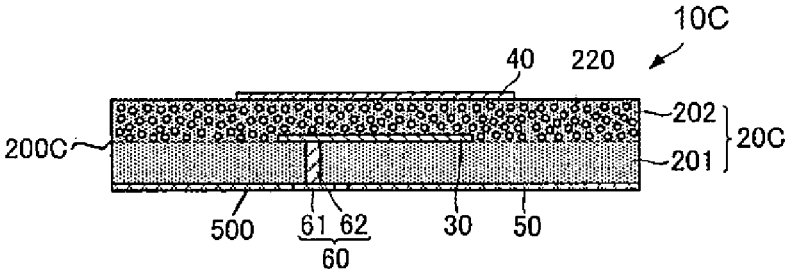
FIG. 7 is a side cross-sectional view of an antenna 10C according to a fourth embodiment of the present disclosure.

Next, an antenna according to a fourth embodiment of the present disclosure is described with reference to the drawings. FIG. 7 is a side cross-sectional view of an antenna 10C according to the fourth embodiment of the present disclosure.

As illustrated in FIG. 7, the antenna 10C according to the fourth embodiment is different from the antenna 10 according to the first embodiment in the configuration of a dielectric substrate 20C. The remaining configuration of the antenna 10C is similar to the configuration of the antenna 10, and the description regarding similar parts is omitted.

The dielectric substrate 20C includes a first dielectric layer 201 and a second dielectric layer 202 that are composed of the same material. In other words, the dielectric substrate 20C is composed of a single material, and the first dielectric layer 201 and the second dielectric layer 202 are formed based on their internal structures.

The first dielectric layer 201 and the second dielectric layer 202 are composed of a material having the same relative permittivity as that of the first dielectric layer 21 of the antenna 10 of the first embodiment. The first dielectric layer 201 does not include any air bubble 220. The second dielectric layer 202 includes a plurality of the air bubbles 220. These air bubbles 220 correspond to the "adjustment member" of the present disclosure. A plurality of the air bubbles 220 is arranged substantially uniformly across the entire part of the second dielectric layer 202.

The dielectric substrate 20C can be realized by stacking one or more dielectric sheets not including the air bubbles 220 and a plurality of dielectric sheets including the air bubbles 220.

With such configuration, even in a case where the first dielectric layer 201 and the second dielectric layer 202 comprise the same material, the effective relative permittivity of the second dielectric layer 202 including a plurality of the air bubbles 220 becomes lower than the effective relative permittivity of the first dielectric layer 201.

This configuration enables to form an electric field boundary plane 200C at the boundary plane between the first dielectric layer 201 and the second dielectric layer 202. Because of this, the relationship between the first dielectric layer 201 and the second dielectric layer 202 of the antenna 10C becomes substantially the same as the relationship between the first dielectric layer 21 and the second dielectric layer 22 of the antenna 10. Accordingly, the antenna 10C achieves functions and effects similar to those of the antenna 10.

Note that in the present embodiment, the mode in which the first dielectric layer 201 does not include the air bubbles 220 is illustrated. However, the first dielectric layer 201 may alternatively include the air bubbles 220 provided that the relationship between the effective relative permittivity of the first dielectric layer 201 and the effective relative permittivity of the second dielectric layer 202 is the same as the foregoing relationship between the relative permittivity $\varepsilon r1$ and the relative permittivity $\varepsilon r2$.

Figure 8:
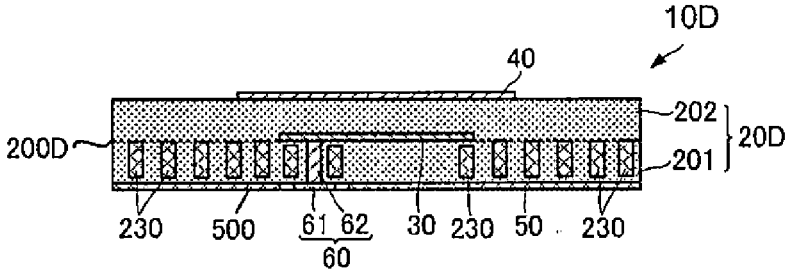
FIG. 8 is a side cross-sectional view of an antenna 10D according to a fifth embodiment of the present disclosure.

Next, an antenna according to a fifth embodiment of the present disclosure is described with reference to the drawings. FIG. 8 is a side cross-sectional view of an antenna 10D according to the fifth embodiment of the present disclosure.

As illustrated in FIG. 8, the antenna 10D according to the fifth embodiment is different from the antenna 10 according to the first embodiment in the configuration of a dielectric substrate 20D. The remaining configuration of the antenna 10D is similar to the configuration of the antenna 10, and the description regarding similar parts is omitted.

The dielectric substrate 20D includes a first dielectric layer 201 and a second dielectric layer 202 that are composed of the same material. In other words, the dielectric substrate 20D is composed of a single material, and the first dielectric layer 201 and the second dielectric layer 202 are formed based on their internal structures.

The first dielectric layer 201 and the second dielectric layer 202 are composed of a material having the same relative permittivity as that of the second dielectric layer 22 of the antenna 10 of the first embodiment. The first dielectric layer 201 includes a plurality of conductive posts 230. This conductive post 230 corresponds to the "adjustment member" of the present disclosure. The plurality of conductive posts 230 is not connected to the radiating element 30, the ground conductor 50, or the feed conductor 60. The plurality of conductive posts 230 is arranged substantially uniformly across the entire part of the first dielectric layer 201.

The dielectric substrate 20D can be realized by stacking a dielectric sheet not including the conductive post 230 and a plurality of dielectric sheets including the conductor posts 230. The conductive post 230 can also be realized by stacking a plurality of dielectric sheets each including a via conductor on top of each other and connecting the via conductors aligned in the thickness direction.

With such configuration, even in a case where the first dielectric layer 201 and the second dielectric layer 202 comprise the same material, the effective relative permittivity of the first dielectric layer 201 including the plurality of conductive posts 230 becomes higher than the effective relative permittivity of the second dielectric layer 202.

This configuration enables to form an electric field boundary plane 200D at the boundary plane between the first dielectric layer 201 and the second dielectric layer 202. Because of this, the relationship between the first dielectric layer 201 and the second dielectric layer 202 of the antenna 10D becomes substantially the same as the relationship between the first dielectric layer 21 and the second dielectric layer 22 of the antenna 10. Accordingly, the antenna 10D achieves functions and effects similar to those of the antenna 10.

Note that in the present embodiment, the mode in which the second dielectric layer 202 does not include the conductive post 230 is illustrated. However, the second dielectric layer 202 may alternatively include the conductive post 230 provided that the relationship between the effective relative permittivity of the first dielectric layer 201 and the effective relative permittivity of the second dielectric layer 202 is the same as the foregoing relationship between the relative permittivity $\varepsilon r1$ and the relative permittivity $\varepsilon r2$.

Figure 9:
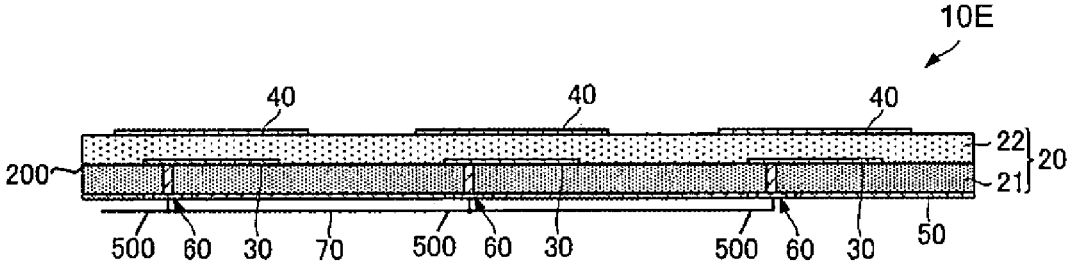
FIG. 9 is a side cross-sectional view of an antenna 10E according to a sixth embodiment of the present disclosure.

Next, an antenna according to a sixth embodiment of the present disclosure is described with reference to the drawings. FIG. 9 is a side cross-sectional view of an antenna 10E according to the sixth embodiment of the present disclosure.

As illustrated in FIG. 9, the antenna 10E according to the sixth embodiment is different from the antenna 10 according to the first embodiment in that the antenna 10E is an array antenna. The basic configuration of the antenna 10E is similar to the configuration of the antenna 10, and the description regarding similar parts is omitted.

The antenna 10E includes a dielectric substrate 20, a plurality of radiating elements 30, a plurality of parasitic elements 40, a ground conductor 50, and a plurality of feed conductors 60. The plurality of feed conductors 60 are connected to a feed line 70.

The dielectric substrate 20 has a multilayer structure of the first dielectric layer 21 and the second dielectric layer 22. Each of the plurality of radiating elements 30 has the same shape. The plurality of radiating elements 30 is arranged so as to form an array on a boundary plane 200 between the first dielectric layer 21 and the second dielectric layer 22. Each of the plurality of parasitic elements 40 has the same shape. The plurality of parasitic elements 40 is arranged so as to form an array on the top face of the dielectric substrate 20.

Using such configuration enables the antenna 10E to realize an array antenna that transmits and receives a dual frequency radio frequency signal and has a predetermined directivity.

Note that in the example illustrated in FIG. 9, the antenna 10E is an array antenna arrayed along one direction, however, the antenna 10E may alternatively be an array antenna arrayed two-dimensionally along two orthogonal directions.

Figure 10:
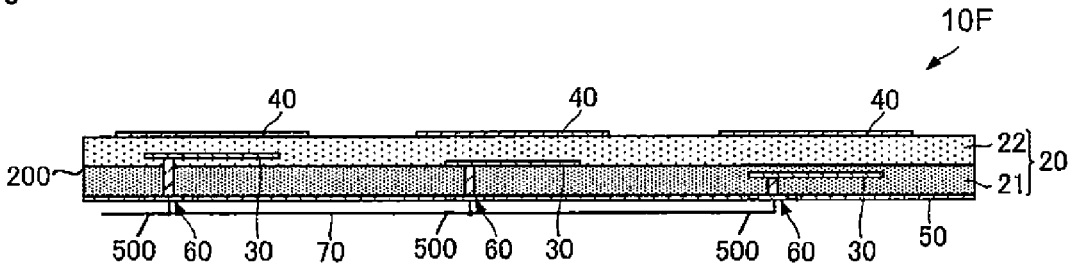
FIG. 10 is a side cross-sectional view of an antenna 10F according to a seventh embodiment of the present disclosure.

Next, an antenna according to a seventh embodiment of the present disclosure is described with reference to the drawings. FIG. 10 is a side cross-sectional view of an antenna 10F according to the seventh embodiment of the present disclosure.

As illustrated in FIG. 10, the antenna 10F according to the seventh embodiment is different from the antenna 10E according to the sixth embodiment in the positions of the plurality of radiating elements 30. The remaining configuration of the antenna 10F is similar to the configuration of the antenna 10E, and the description regarding similar parts is omitted.

Each of the plurality of radiating elements 30 has a configuration that follows the foregoing configuration of the antenna 10, the antenna 10A, or the antenna 10B, and the thickness direction position thereof in the dielectric substrate 20 is set appropriately. For example, in the mode illustrated in FIG. 10, a first radiating element 30 is placed on the boundary plane 200 between the first dielectric layer 201 and the second dielectric layer 202, a second radiating element 30 is placed inside the first dielectric layer 201, and a third radiating element 30 is placed inside the second dielectric layer 202.

As is the case with the antenna 10E, using such configuration enables the antenna 10F to realize an array antenna that transmits and receives a dual-frequency radio frequency signal and has a predetermined directivity. Further, using such configuration enables the antenna 10F to adjust the directivity of the first radio frequency signal. This enables to realize a wider variety of radiation characteristics for the first radio frequency signal.

Note that in the example illustrated in FIG. 10, the antenna 10F is an array antenna arrayed along one direction, however, the antenna 10F may alternatively be an array antenna arrayed two-dimensionally along two orthogonal directions.

Further, in the foregoing embodiments, the example with dual frequency is used. However, the foregoing embodiments are also applicable to cases with triple frequency or more, provided that at least a radiating element is used for a radio frequency signal of the lowest frequency and a parasitic element is used for a radio frequency signal of the highest frequency.

10, 10A, 10B, 10C, 10D, 10E, 10F. Antenna
20, 20C, 20D Dielectric substrate
21 First dielectric layer
22 Second dielectric layer
30 Radiating element
40 Parasitic element
50 Ground conductor
60 Feed conductor
61 Feed terminal conductor
62 Connection conductor
70 Feed line
200, 200C, 200D Boundary plane
201 First dielectric layer
202 Second dielectric layer
220 Air bubble
230 Conductive post
500 No-conductor-formation part

The invention claimed is:

1. An antenna comprising:

a plate-like dielectric substrate having a top face and a back face, the top face and the back face being opposite to one another;

a radiating element placed between the top face and the back face of the dielectric substrate, the radiating element transmitting and receiving a radio frequency signal of a first frequency;

a parasitic element placed on the top face of the dielectric substrate, the parasitic element transmitting and receiving a radio frequency signal of a second frequency; and a ground conductor placed on the back face of the dielectric substrate, wherein:

the second frequency is a lower frequency than the first frequency, the dielectric substrate has an electric field boundary plane at an intermediate position in a thickness direction orthogonal to the top face and the back face, the electric field boundary plane reflecting the radio frequency signal of the second frequency, the dielectric substrate includes:

a first dielectric layer having a first relative permittivity, and a second dielectric layer having a second relative permittivity, the second relative permittivity being a lower permittivity than the first relative permittivity, the first dielectric layer and the second dielectric layer are stacked on top of each other, and the top face of the dielectric substrate is a face of the second dielectric layer on a side opposite to a side of the second dielectric layer facing the first dielectric layer, and a difference between the first relative permittivity and the second relative permittivity is greater than or equal to three.

2. The antenna according to claim 1, wherein the first dielectric layer and the second dielectric layer comprise different materials.

3. The antenna according to claim 1, wherein:

the first dielectric layer and the second dielectric layer comprise a same material, and the first dielectric layer or the second dielectric layer includes an adjustment member changing an effective relative permittivity.

4. The antenna according to claim 3, wherein the second dielectric layer includes the adjustment member, and the adjustment member lowers an effective relative permittivity of the second dielectric layer.

5. The antenna according to claim 3, wherein the first dielectric layer includes the adjustment member, and the adjustment member increases an effective relative permittivity of the first dielectric layer.

6. The antenna according to claim 1, further comprising:

a plurality of parasitic elements including the parasitic element and a plurality of radiating elements including the radiating element, wherein the plurality of parasitic elements and the plurality of radiating elements are arrayed.

7. The antenna according to claim 4, wherein the first dielectric layer also includes the adjustment member, and the adjustment member increases an effective relative permittivity of the first dielectric layer.

8. The antenna according to claim 2, further comprising:

a plurality of parasitic elements including the parasitic element and a plurality of radiating elements including the radiating element, wherein the plurality of parasitic elements and the plurality of radiating elements are arrayed.

9. The antenna according to claim 3, further comprising:

a plurality of parasitic elements including the parasitic element and a plurality of radiating elements including the radiating element, wherein the plurality of parasitic elements and the plurality of radiating elements are arrayed.

10. The antenna according to claim 4, further comprising:

a plurality of parasitic elements including the parasitic element and a plurality of radiating elements including the radiating element, wherein the plurality of parasitic elements and the plurality of radiating elements are arrayed.

11. The antenna according to claim 5, further comprising:

a plurality of parasitic elements including the parasitic element and a plurality of radiating elements including the radiating element, wherein the plurality of parasitic elements and the plurality of radiating elements are arrayed.

12. The antenna according to claim 1, wherein a difference between the first and second permittivities is predetermined to reflect the radio frequency signal of the second frequency transmitted or received by the parasitic element.

* * * * *